United States Patent [19]

Postma et al.

[11] 4,029,482

[45] June 14, 1977

[54] ELECTROSTATIC REMOVAL OF AIRBORNE PARTICULATES EMPLOYING FIBER BEDS

[75] Inventors: Arlin Keith Postma, Benton City; W. Kevin Winegardner, Richland, both of Wash.

[73] Assignee: Battelle Memorial Institute, Richland, Wash.

[22] Filed: June 30, 1975

[21] Appl. No.: 591,278

Related U.S. Application Data

[63] Continuation of Ser. No. 453,714, March 27, 1974, abandoned.

[52] U.S. Cl. ..... 55/2; 55/131; 55/155

[51] Int. Cl.[2] ..... B03C 3/00

[58] Field of Search ..... 55/2, 6, 101, 131, 132, 55/154, 155

[56] References Cited

UNITED STATES PATENTS

| | | | |
|---|---|---|---|
| 2,589,463 | 3/1952 | Warburton | 55/131 |
| 2,593,377 | 4/1952 | Wintermote | 55/131 |
| 2,812,038 | 11/1957 | Krueger | 55/131 |
| 2,844,214 | 7/1958 | Hall et al. | 55/131 |
| 2,888,092 | 5/1959 | Powers | 55/132 |
| 3,046,717 | 7/1962 | Northrup et al. | 55/155 |
| 3,237,387 | 3/1966 | Haugen et al. | 55/155 |
| 3,307,332 | 3/1967 | Grace et al. | 55/103 |
| 3,468,869 | 9/1969 | Sherborne | 55/2 X |
| 3,518,488 | 6/1970 | Michalchick | 55/2 |

*Primary Examiner*—FranK W. Lutter
*Assistant Examiner*—David L. Lacey
*Attorney, Agent, or Firm*—Wells, St. John & Roberts

[57] ABSTRACT

A method and apparatus for collecting aerosol particles. The particles are subjected to an electrostatic charge prior to collection in an electrically resistive fiber bed. The method is applicable to particles in a broad size range, including the difficult-to-remove particles having diameters between 0.01 and 2 microns.

6 Claims, 5 Drawing Figures

POWER SOURCE
14

20
11
16
15
16
13
18
17
AEROSOL SOURCE
12
10

POWER SOURCE
26

30
22
28
29
25
24
27
21
AEROSOL SOURCE
23

ELECTROSTATIC REMOVAL OF AIRBORNE PARTICULATES EMPLOYING FIBER BEDS

This is a continuation of application Ser. No. 453,714 filed Mar. 27, 1974, now abandoned.

BACKGROUND OF THE INVENTION

This disclosure relates to the collection of charged particles in an electrically resistive relatively porous bed of fibers or other material. In comparison to other types of electrostatic precipitators, the present invention represents an improvement in terms of higher collection efficiency for small particles, much lower cost, and smaller equipment size. As compared to conventional filters, this represents a great improvement with respect to energy requirements associated with filter pressure loss, allowable operating velocity, and cost.

Several earlier studies have dealt with collection of charged particles by fiber beds, but did not demonstrate the dramatic influence from electric charge which is observed in the present invention. Prior researchers have developed a theoretical analysis of the deposition of particles on spheres and cylinders. This has directed those in the art to propose use of an electrically-charged filter made from fine wire. Others have tested fibrous filters consisting of layers of fibers separated by charged metal screens. Adjacent screens carried opposite charges, giving rise to an electric field which enhanced collection.

Research with respect to penetration of sub-micron particles in filter paper has included study of the results of an electric charge on the particles. The electric charge enhanced collection, but not remarkably so. Reported results for 0.3 micron particles showed penetration of highly-charged particles of 17% compared to 25% for uncharged particles at a linear velocity of 1.3 feed per minute. Charging of particles has also been demonstrated to be important in the collection of particles by fabric filters. Others have described a two-material filter designed to improve particle collection by building a charge on the filter by contacting it with a belt. The charges were observed to enhance the collection of atmospheric dust, but the enhancement was modest and the absolute removal efficiencies were too low to be of practical interest.

An article title "Effect of Particle Electrostatic Charge on Filtration by Fibrous Filters" by Lundgren and Whitby, *I J EC Process Design and Development*, Vol. 4, No. 4, October, 1965, reported experiments in which unipolar charged dye particles were captured in filters made from wool felt, urethane foam, and silver-plated glass fibers. The article concluded that "image forces;" (i.e. the force between a charged particle and its electrical image in a fiber) caused the observed enhancement of collection efficiencies when the particles were charged. Improvement in removal efficiency for sub-micron particles was typically modest and limited to low speed applications. As an example, 0.1 micron particles were captured within a polyurethane filter with an efficiency of 28% when charged with 6 electronic units, compared to an efficiency of 18% for neutral particles. The results were obtained with an air velocity of 10 feet per minute. Increases in the collection efficiency of a felt filter were obtained by charging the particles, but again the reported air flow velocity was only 4.4 feet per minute. These results are believed to demonstrate that image forces are not sufficiently strong to enhance collection of sub-micron particles in filter beds in a fast-moving air stream.

In the present invention, image forces are not the dominant means for collecting particles. This is demonstrated by an observed large decrease in collection efficiency when the bed was wet by water spray and by a great decrease in efficiency when using a conductive filter bed. In the case of a wetted or conductive bed, image forces would be expected to dominate the collection.

SUMMARY OF THE INVENTION

The method disclosed herein basically relates to the steps of charging the particulates in a gas stream with an electrostatic charge that is unipolar, and subsequently passing the stream and the charged particles through a porous, electrically-resistive filter medium. The filter medium should have relatively high porosity so as not to impede the flow of gas and substantial thickness to provide the space charge effect that causes the particles to deviate from the direction of stream flow and thereby deposit on the filter material.

The apparatus comprises a housing having an inlet and outlet through which the gaseous stream is passed. A corona discharge apparatus electrostatically charges each incoming particle. An electrically-resistive bed of fibers, particulate material, or other porous configuration removes the charged particles from the gaseous stream prior to its discharge through the housing outlet.

One object of this invention is to provide an apparatus for removing charged particulate matter from an aerosol by means of a fiber bed or other filter medium having a space charge through the filter thickness when collection of particles occurs. This space charge causes the particles to deviate from the direction of stream flow and thereby increases the efficiency of the filter beyond that which occurs in filters which do not employ the space charge effect.

Another object is to provide a method of electrostatically removing airborne particulates by deposition of particles on fiber beds having high porosity, thereby decreasing the energy required for particulate removal. In this arrangement, very little energy is used to force the stream of gas through the filter.

Another object of this invention is to increase the removal of particulates from a moving gaseous stream beyond that which would be theoretically calculated for removal by the action of image forces between charged particles and fibers. The increase is believed to be attributable to the development of an appreciable charge density throughout a substantial thickness of filter medium. The filter bed charge is self-induced and constitutes a non-uniform electrostatic field created by the accumulation of charged particles on the filter medium.

Another object of the invention is to provide an alternative to conventional electrostatic precipitators, which normally require very large physical installations and considerable capital expense and power consumption needs. The present apparatus and method are believed to be much more efficient for removal of sub-micron particles of electrically-resistive particles in a moving gaseous stream at substantial gas velocities.

Another object of the invention is to provide a method and an apparatus that can be practiced in conjunction with conventional electrostatic precipitator methods. A dry filter bed as described herein might be located downstream of an electrostatic precipitator to further remove sub-micron particles that have passed through the precipitator. No additional electrostatic charge need be directed to the particles in such a joint installation.

These and further objects will be evident from the following disclosure and the discussion of the preferred embodiment.

DESCRIPTION OF THE PREFERRED EMBODIMENT

The air cleaning process and apparatus described herein is applicable to a broad range of industrial processes where the discharged gas contains electrically-resistive particulate pollutants. Examples include aluminum reduction plants, fossil fuel-fired power plants, open hearth steel furnaces and wood pulp production plants.

Figure 1:
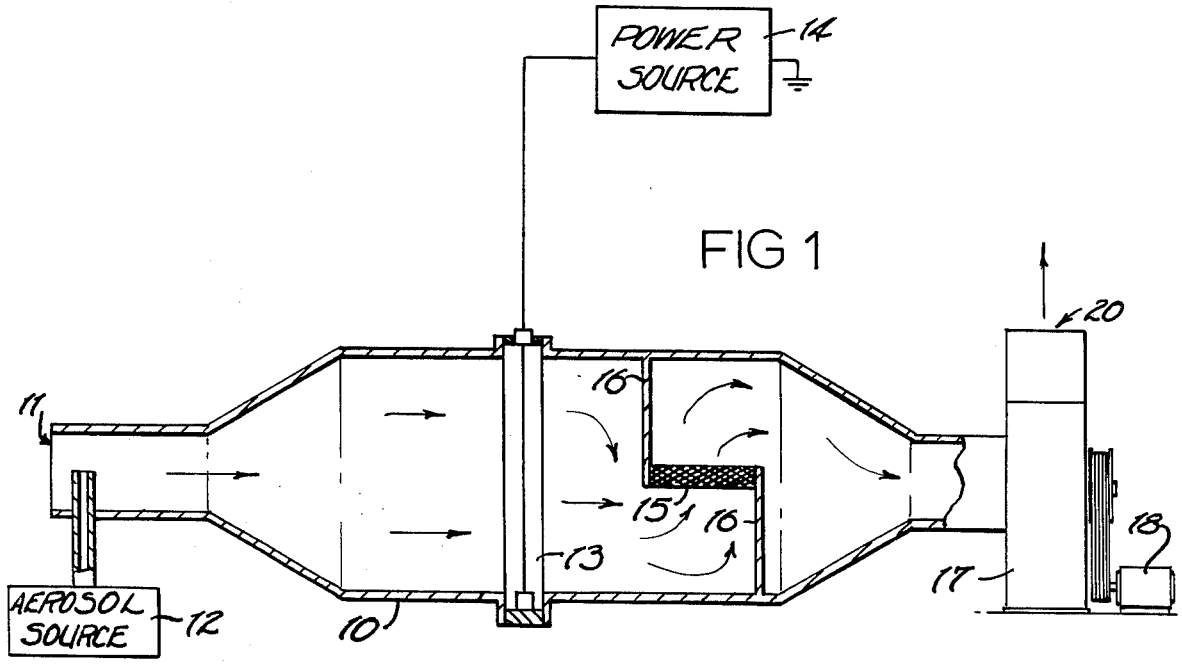
FIG. 1 is a schematic side view in partial section of an apparatus for practicing the invention.
Figure 2:
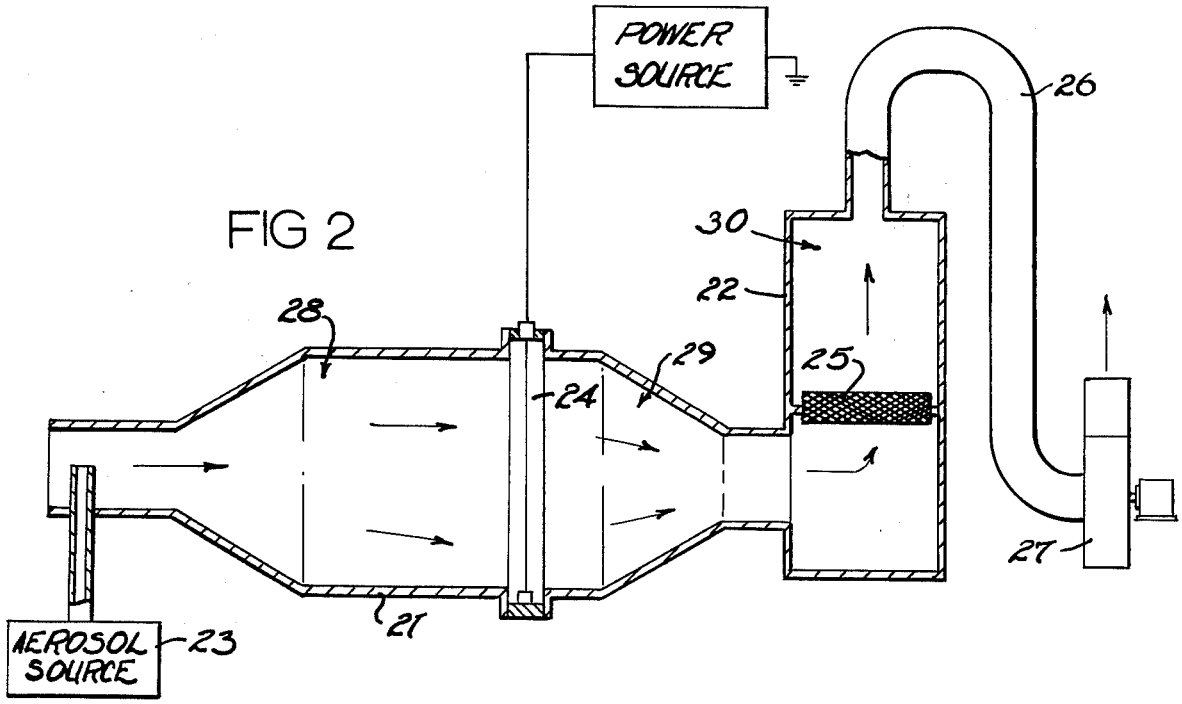
FIG. 2 is a schematic side view of a modified apparatus.

FIGS. 1 and 2 illustrated schematically the basic elements of the apparatus. The two assemblies are essentially similar, FIG. 1 showing an in-line arrangement of the components and FIG. 2 showing an alternative arrangement with an upright flow pattern.

Referring to FIG. 1, the apparatus includes a cylindrical housing 10 having an air inlet 11 which receives the aerosol from a source generally indicated at 12. In a laboratory, the source 12 might be a fume generator. In industry, it will be the apparatus producing the pollutant which is to be removed from the exiting air stream.

The aerosol particles are charged by a conventional corona wire charging assembly shown generally at 13. The corona wire assembly 13 is electrically connected to a power supply illustrated at 14. Downstream from the corona wire assembly 13 is a filter bed 15 with supporting solid walls 16 at each of its sides, forcing all air through the housing 10 to pass upwardly through the filter bed 15. The filter bed 15 may be horizontal as shown, or vertical, or any desired angular orientation with respect to the direction of gas flow. The stream of air and particles is directed through housing 10 by an exhaust fan 17 powered by a conventional drive motor assembly shown at 18. The final exiting air leaves the apparatus at 20.

The filter bed 15 is of substantial thickness in the direction of air flow from an upstream location where the gaseous stream enters the bed to a downstream location where it leaves the bed and is composed of material that is highly electrically-resistive. It can be a bed or mat of plastic or glass fibers, or it can be a bed of particles or a sponge-like body. An example of a suitable fiber bed for this purpose is a product produced by Otto H. York Company, Inc. of Parsippany, New Jersey under the trademark "The Demister," which is a mist eliminator for separating mist and entrained liquid from a vapor stream. This product is produced from resins such as polyethylene, polypropylene and "Teflon," all of which are suitable for this application. The fibers are in the form of parallel screen layers which form a relatively porous filter bed. In a typical construction, the fibers are 10–11 mils in diameter and a bed six inches thick has about 95% porosity. The porosity of the filter bed is substantially greater than that normally used for dry air filters. The filter bed 15 is comprised of fibers having a diameter substantially greater than the diameter of the particles in the gaseous stream.

In a laboratory test of the apparatus shown in FIG. 1, the filter bed 15 was 6 inches thick and constructed from a polypropylene Demister unit. It had a projected area of 9.3 square feet. At the design flow rate of 3,000 cubic feet per minute, the air velocity was 322 feet per minute.

Figure 3:
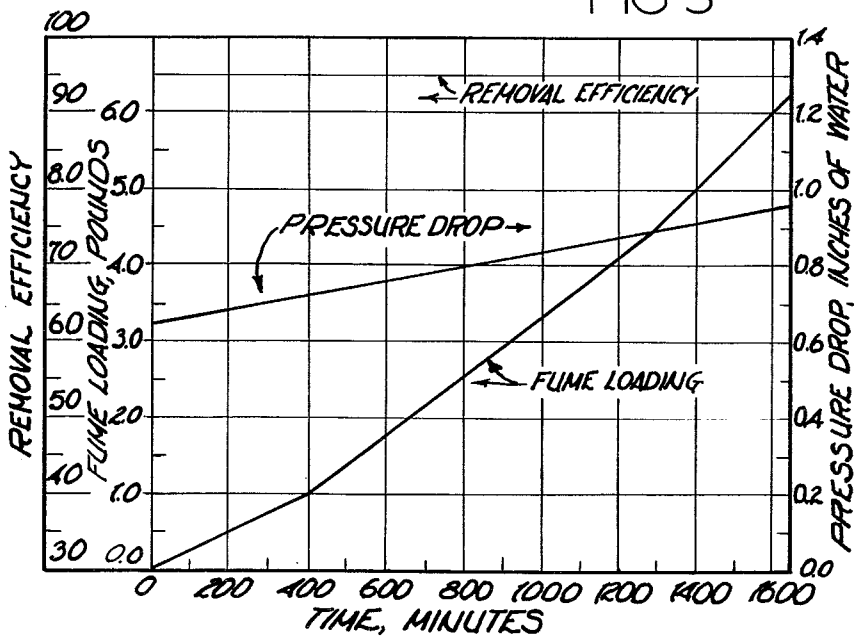
FIG. 3 is a plot of average results obtained by use of the apparatus in FIG. 1.

The test was carried out by generation of cryolite ($Na_3AlF_6$) at the source 12. The aerosol was subjected to a saturation charge on each submicron particle. Removal efficiency in the dry filter bed varied from 90% to 100%, and the pressure drop across the filter bed increased from 0.64 to 0.97 inches of water. The average efficiency was 95%. A graph showing the average pressure drop, removal efficiency and fume loading of tests carried out in the apparatus shown in FIG. 1 is illustrated at FIG. 3.

Prior research efforts relating to charging of aerosol particles have attempted to capitalize on image forces at the filter to improvefilter collection. The image force is recognized generally as the force between a charged particle and its electrical image in a fiber. To determine whether image forces were the factor contributing to the results displayed in FIG. 3, the apparatus of FIG. 1 was operated with uncharged aerosol particles when the filter bed 15 was wet by water spray. Particle removal efficiency was only 5% in such tests. The efficiency increased to 32% when the particles were unipolarly charged. This increase can be attributed to image force attraction. However, the much more significant increase in removal efficiency (above 90%) using charged particles and a dry resistive filter bed goes beyond the increase that can be attributed to image forces. It is our conclusion that space charge fields, self-induced and originating from the charged particles on the filter bed 15 are responsible for the high-efficiency collection that resulted.

Further testing of the apparatus shown in FIG. 1 at a flow rate of 750 cubic feet per minute indicated a removal efficiency of 98%, showing that the removal efficiency increases as the velocity through the filter bed decreases. As velocity decreases, the dispersal of particles thoughout the filter bed due to the unchanged electrical forces will increase.

After an appreciable mass of cryolite fume was loaded onto the filter bed 15, the filter bed 15 was washed with a water spray. The water spray appeared to effectively clean the bed and a return of pressure drop to the "clean" initial condition was achieved.

Results of tests of the apparatus carried out with effluent from operating aluminum reduction cells were as follows:

Table I

Removal of Particles from Pot Effluent Gas by Dry Polypropylene Fiber Bed

| Air Flow | Corona Current | Test Duration | Removal Efficiency |
|---|---|---|---|
| 3000 cfm | 20 ma | 31 min | 97.0 |

Table I-continued

| Removal of Particles from Pot Effluent Gas by Dry Polypropylene Fiber Bed | | | |
|---|---|---|---|
| Air Flow | Corona Current | Test Duration | Removal Efficiency |
| 3000 | 20 | 129 | 96.1 |

These data confirm the high removal efficiency obtainable for sub-micron particles using the apparatus and process of this disclosure.

The collection mechanism involved in this process apparently depends upon the collection of charged particles by self-induced electric fields within a resistive fiber bed. Thus, efficient operation depends on development of electric fields which can cause particle precipitation within times smaller than the residence time of the air stream within the bed. This apparently occurs because of electrical forces which cause the particles to deviate from the direction of air movement as they pass through the porous filter. The following variables are believed to play important roles in the capture of the particles:

Particle size influences the mobility of the particles, small particles being susceptible to deviation from the air stream due to electrical forces. This makes the process particularly useful in removal of sub-micron particles.

Air velocity through the filter bed controls the residence time of the particles in the vicinity of a fiber. Decreasing air velocity increases the residence time and likelihood of particle capture.

Pad resistivity influences the charge leakage rate. The higher the resistivity of the fibers, the greater are the sustaining electrical forces in the space fields created within the filter beds.

Pad thickness controls residence time of the particles passing through the filter bed and the total target area of the fibers.

Dust surface coverage will be uniform or non-uniform as a function of the air flow geometry through the filer bed. Coverage also is modified by the charge leakage rate at the filter bed.

Particle resistivity influences the charge leakage to the filter bed and surrounding environment.

Charge level on particles influences the mobility of the particles. An increased charge level increases the electrical forces on individual particles. The charge level is preferably near saturation.

The total charge interception rate should be controlled so as to produce the maximum field in the filter bed due to the charged particles entrapped therein. An increase in the total dust loading should increase the electric field in the filter bed due to the resulting increase in charge density.

Further tests have been conducted through an apparatus illustrated in FIG. 2. It includes a horizontal duct 21 and an upright chamber 22. In a laboratory-scale model, the duct 21 was 2½ feet in diameter and chamber 22 was 6 feet in diameter. Aerosol-laden air was drawn from a source 23 into the duct 21 and passed through a corona charger 24. The charger comprised parallel vertical plates and wires (3 in a line). The air then entered the bottom of chamber 22, which was 12 feet in height. The fiber filter bed 25 was mounted at the 3 foot level and had a nominal area of 8 square feet. After passing through the filter bed 25, the air passed through a duct system 26 to an exhaust fan 27. The aerosol was sampled in three locations — upstream of the corona charging section (at 28), downstream of the corona charging section (at 29), and downstream of the filter bed 25 (at 30).

To provide aerosol for the test, ammonium chloride aerosol was generated by bubbling separate controlled flows of air through aqueous $NH_4OH$ and aqueous HCl and mixing the two streams to form $NH_4Cl$. Various dust loadings were obtained by controlling the ratio of the saturated and reacted air streams and the dilution air. Particle size measurements were made primarily on samples drawn upstream of the corona charger 24.

Data was obtained via the following run plan:

$t = 0$ min.

Start aerosol generation by setting the controlled flow of gas through the aqueous solutions of $NH_4OH$ and HCl. Set corona charger at 26 KV which results in a corona current at approximately 12.5 ma. Set total flow through the apparatus as determined by a centerline pitot tube reading and checked by a complete traverse.

$t = 15$ min.

Determine the resistivity of the aerosol from an in-situ sample taken upstream of the corona charger. Periodically obtain a particle size measurement on a sample taken at the same location.

$t = 45$ min.

Start sampling and record values of sample flow rate and pressure drop every five minutes.

$t = 75$ min.

Stop sampling.

$t = 80$ min.

Measure overall charge flux upstream and downstream of the bed.

$t = 90$ min.

Weigh filter and impactor plates.

Figure 4:
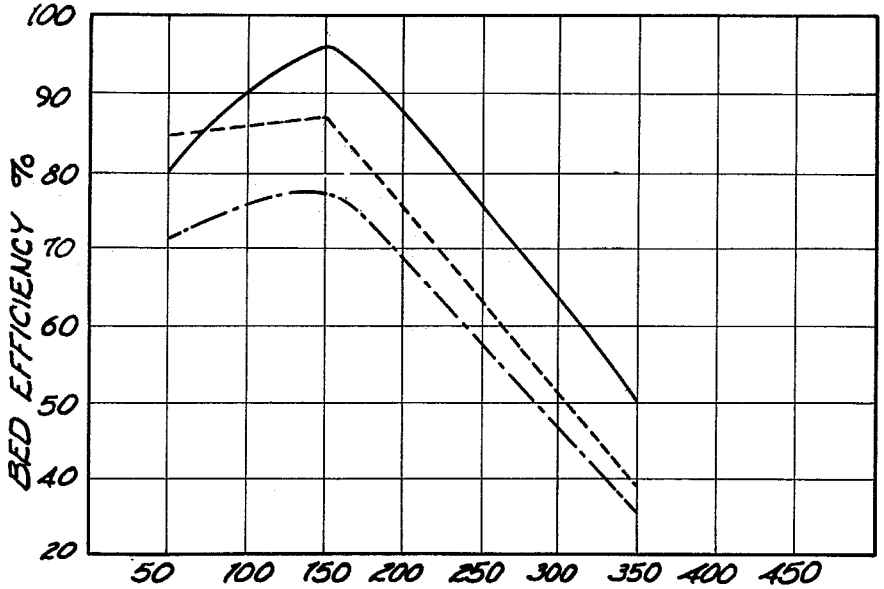
FIG. 4 is a plot of removal efficiency versus velocity for a six inch filter bed.
Figure 5:
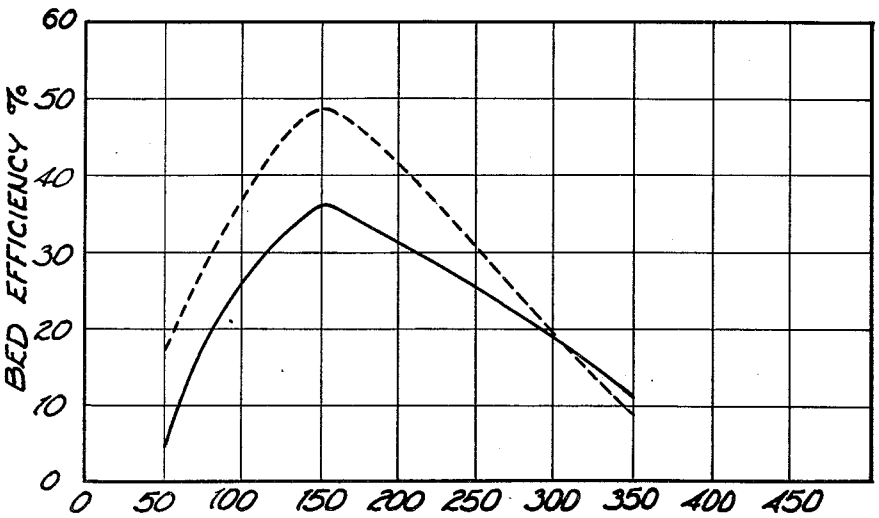
FIG. 5 is a plot of removal efficiency versus velocity for a three inch filter bed.

The results of runs made with the ammonium chloride aerosol are provided in Tables II through IV. The overall efficiency is based on the sample quantity of aerosol at the inlet of duct 21 upstream from the corona charger 24, at 28 and downstream from the fiber bed 25 at 30. It includes the aerosol deposited on the plates of the corona charger. The bed efficiency is based on the downstream sample and the upstream sample at 29 between the corona charger and the fiber bed. As such it measures essentially the quantity of aerosol deposited on the fiber bed 25. FIGS. 4 and 5 show the variation of removal efficiency as a function of superficial gas velocity through the bed with the nominal dust loading shown as a parameter.

TABLE II.

| Aerosol Deposition in a 6-Inch Polypropylene Bed | | | |
|---|---|---|---|
| Bed Vel. | Dust Conc. | Overall Efficiency | Bed Eff. |
| 50 ft/min | 9 mg/m³ | 90.8% | 79.7% |
| 50 | 26 mg/m³ | 97.9% | 85.5% |
| 50 | 56 mg/m³ | 95.1% | 70.6% |
| 150 ft/min | 7 mg/m³ | 99.3% | 98.7% |
| 150 | 23 | 91.8% | 87.0% |
| 150 | 53 | 85.6% | 77.8% |
| 350 ft/min | 10 mg/m³ | 67.3% | 51.4% |
| 350 | 28 | 61.7% | 38.5% |
| 350 | 74 | 62.8% | 35.5% |

TABLE III.

Aerosol Deposition in a 3-Inch Polypropylene Bed

| Bed Vel. | Dust Conc. | Overall Efficiency | Bed Eff. | ΔP Bed |
|---|---|---|---|---|
| 50 ft/min | 14 mg/m³ | 78.6% | 5% | .01" $H_2O$ |
| 50 ft/min | 30 mg/m³ | 82.9% | 17.7% | .01" $H_2O$ |
| 150 ft/min | 10 mg/m³ | 76.3% | 36.7% | .11" $H_2O$ |
| 150 ft/min | 21 mg/m³ | 80% | 48% | .20" $H_2O$ |
| 350 ft/min | 6 mg/m³ | 24.3% | 11% | .33" $H_2O$ |
| 350 ft/min | 28 mg/m³ | 37.9% | 10.4% | .33" $H_2O$ |

TABLE IV.

Aerosol Deposition in a 6-Inch Stainless Steel Bed

| Bed Vel. | Dust Conc. | Overall Efficiency | Bed Eff. |
|---|---|---|---|
| 50 ft/min | 14 mg/m³ | 85.2% | 18.6% |
| 350 ft/min | 7 mg/m³ | 42% | 0% |
| 350 ft/min | 70 mg/m³ | 47% | 0% |

The above tables demonstrate that the variation in efficiency of both the 6 inch and 3 inch filter beds with air velocity is similar, with a peak in efficiency observed at the intermediate velocity of 150 feet per minute. The reason for this apparent maximum efficiency is not known at this time. Moreover, the effect of dust loading on the performance of the two beds is not consistent, but in general the efficiency of the three-inch bed is lower, as one would anticipate.

The results obtained by use of the stainless steel fiber bed were as anticipated, again being attributed to the image forces on the particles. The efficiency of the stainless steel fiber bed was very low when compared with the six-inch polypropylene bed.

These tests were conducted to analyze the capture of charged sub-micron particles on fiber beds. In each test the ammonium chloride particles had a mass median diameter ranging from 0.25 microns to 0.35 microns and a powder resistivity of approximately $10^8$ ohm-cm. The aerosols were charged to essentially the saturation level. The results show that as the flow rate through the bed was increased from 50 feet per minute to 350 feet per minute, the collection efficiency initially increased and then decreased (FIGS. 4, 5). Collection efficiency was a weak function of the aerosol loading. The maximum removal efficiency measured at a flow rate of 150 feet per minute average 87% for the three dust loadings in the 6 inch polypropylene bed and 42% in the three-inch polyprophylene bed. In the six-inch stainless steel bed, the average maximum removal efficiency for the 3 dust loadings was 18%, which is approximately that anticipated for removal by image forces developed in conducting fibers by the charged particulates.

Some of the quantitative discrepancies in the above tests may be attributed to the fact that with both the three-inch polypropylene bed and the six-inch stainless steel bed there was some loss of initially-deposited solids, particularly at the higher velocities. Further testing may show a threshold velocity for any given bed at which the shear force of the passing gas or air upon the solids deposited on the fibers is greater than the adhesion of the particles to the fibers.

The lower efficiency of the stainless steel bed illustrates the importance of space effects. The higher conductivity filter bed results in charge leakage and a much lower charge level on the filter. It is believed that image forces are the only significant contributor to increased deposition of charged particles on the bed as compared to collection of uncharged particles.

The basic process steps involve the charging of the particles to a highly charged and preferably saturated state and subsequent passage though an electrically-resistive filter bed having substantial thickness, wherein the deposited particles can produce a space charge effect. The physical and process changes can be made with respect to the examples described in detail above, while maintaining this basic relationship. Therefore, only the following claims are intended as a definition of the invention described herein.

Having thus described our invention, we claim:

1. A method of removing an aerosol from a confined moving gaseous stream, the aerosol being composed of electrically resistive particles capable of accepting and retaining an electrical charge; said method comprising the following steps:

passing the confined gaseous stream through a corona discharge;

subsequently directing the confined gaseous stream through a dry porous bed having:

a. a physical location spaced downstream from the corona discharge;

b. substantial bed thickness in the direction of movement of the gaseous stream from an upstream location where the gaseous stream enters the bed to a downstream location where it leaves the bed;

c. relatively high porosity so as not to impede the flow of gas;

e. a structure composed of electrically resistive material;

the passage of the gaseous stream through the corona discharge and bed resulting in the production of a self-induced space charge field originating from the charged particles on the bed;

introducing the aerosol into the moving gaseous stream at a location upstream of the corona discharge whereby each particle in the aerosol is electrically charged by the emission of the corona discharge as the gaseous stream passes therethrough, the charge on each particle being a near-saturation charge of the same polarity as the space charge on the bed material;

and collecting the charged aerosol particles by deposition within the physical boundaries of the bed due to the electrical forces that result from the interaction of the charged particles and the space charge field during passage of the gaseous stream through the porous bed.

2. A method as set out in claim 1 wherein the porous bed comprises fibers having a diameter substantially greater than the diameter of the particles in the gaseous stream.

3. A method as set out in claim 1 wherein the electrically resistive material comprising the porous bed is selected from the class consisting of polypropylene, glass, Teflon and polyethylene.

4. A method as set out in claim 1 wherein the material comprising the porous bed is selected from the class consisting of polypropylene, glass, Teflon and polyethylene, and wherein the porous bed has a porosity of approximately 95%.

5. A method of removing an aerosol from a confined moving gaseous stream, the aerosol being composed of electrically resistive particles capable of accepting and retaining an electrical charge; said method comprising the following steps:

providing a dry, highly porous, electrically resistive bed of substantial thickness, the porosity of the bed being of a degree so as to not substantially impede flow of the gaseous stream through the bed;

locating the porous bed in the path of the entrained moving gaseous stream, said bed being oriented so as to present a substantial bed thickness in the direction of movement of the gaseous stream from an upstream location where the gaseous stream enters the bed to a downstream location where it leaves the bed;

placing an electrostatic charge of like polarity on the individual particles within the gaseous stream, the charge being placed on the particles at a location upstream from the porous bed;

maintaining the charge on the individual particles as they move within the gaseous stream and enter the physical boundaries of the porous bed;

directing the confined gaseous stream through the thickness of the bed to produce a space charge on the surfaces of the bed of the same polarity as the charge on the individual particles;

and collecting the aerosol particles by deposition within the physical boundaries of the bed due to the electrical forces that result from the space charge.

6. An apparatus for removing an aerosol from a confined moving gaseous stream, wherein the apparatus has an inlet and outlet for the gaseous stream and wherein the aerosol is composed of electrically resistive particles capable of accepting and retaining an electrical charge; said apparatus comprising:

electrostatic charging means in the path of the moving gaseous stream at a location between the inlet and outlet of the apparatus for imparting an electrostatic charge of like polarity on individual particles within the gaseous stream;

and dry porous bed means between the charging means and outlet in the path of the moving gaseous stream for collecting the aerosol particles by deposition within its physical boundaries due to electrical forces that result from a space charge field produced within the bed means as the gaseous stream passes therethrough;

said porous bed means being composed of a material that is electrically resistive;

said porous bed means having substantial thickness in the direction of movement of the gaseous stream from an upstream location where the gaseous stream enters the bed to a downstream location where it leaves the bed, and said porous bed means being sufficiently porous as to not substantially impede flow of the gaseous stream.

* * * * *